US012246237B2

(12) United States Patent
Kim

(10) Patent No.: US 12,246,237 B2
(45) Date of Patent: Mar. 11, 2025

(54) GOLF PRACTICE APPARATUS

(71) Applicant: William Kim, Vernon, CA (US)

(72) Inventor: William Kim, Vernon, CA (US)

( * ) Notice: Subject to any disclaimer, the term of this patent is extended or adjusted under 35 U.S.C. 154(b) by 832 days.

(21) Appl. No.: 17/393,297

(22) Filed: Aug. 3, 2021

(65) Prior Publication Data

US 2023/0039965 A1 Feb. 9, 2023

(51) Int. Cl.
*A63B 69/36* (2006.01)
*A63B 71/02* (2006.01)
*A63B 102/32* (2015.01)

(52) U.S. Cl.
CPC ..... *A63B 69/3661* (2013.01); *A63B 69/3676* (2013.01); *A63B 71/022* (2013.01); *A63B 2102/32* (2015.10)

(58) Field of Classification Search
CPC ..... A63B 71/022; A63B 69/3661; A63B 69/3676; A63B 2063/001
See application file for complete search history.

(56) References Cited

U.S. PATENT DOCUMENTS 2,895,737 A * 7/1959 Blees ..... A63B 63/00 D21/705
3,601,406 A * 8/1971 Giusti ..... A63B 69/3623 473/165
5,042,813 A * 8/1991 Huang ..... A63B 67/02 473/197
5,306,009 A * 4/1994 Bolanos ..... A63B 63/00 473/157
6,165,085 A * 12/2000 Lubin ..... A63B 63/004 273/400
7,207,893 B1 * 4/2007 Louie ..... A63B 63/00 473/166
2003/0109325 A1 * 6/2003 Carlton ..... A63B 69/3661 473/278
2003/0125121 A1 * 7/2003 Rhee ..... A63B 63/00 473/197
2004/0152529 A1 * 8/2004 Chen ..... A63B 67/02 473/197
2005/0209027 A1 * 9/2005 Joseph ..... A63B 69/406 473/451
2006/0199658 A1 * 9/2006 Leonard ..... A63B 63/00 473/197
2007/0281807 A1 * 12/2007 Cho ..... A63B 63/004 473/478

(Continued)

FOREIGN PATENT DOCUMENTS

CA 2089526 C * 11/1998 ..... A63B 63/00
KR 20110129684 A * 5/2010
WO WO-2018030822 A1 * 2/2018 ..... A63B 69/36

*Primary Examiner* — Joshua T Kennedy
(74) *Attorney, Agent, or Firm* — Heedong Chae; Lucem, PC

(57) ABSTRACT

A golf practice apparatus for putting and short game practices that includes a base, which includes a green portion, a hole, and a coupling groove; a mat which includes a first end portion and a second end portion; and a target assembly that includes a netting, a frame, and a connecting member. The second end portion is attached to the base, and the coupling groove of the base and the connecting member of the target assembly are constructed such that the connecting member is removably received in the coupling groove to secure the target assembly to the base.

16 Claims, 11 Drawing Sheets

(56) References Cited

U.S. PATENT DOCUMENTS

| | | | | |
|---|---|---|---|---|
| 2009/0176590 | A1* | 7/2009 | Cho | A63B 69/3661 473/162 |
| 2010/0292033 | A1* | 11/2010 | Sarver | A63B 63/00 473/431 |
| 2011/0256945 | A1* | 10/2011 | Hsiang | A63B 71/0669 473/197 |
| 2021/0038964 | A1* | 2/2021 | Beard | A63B 69/3623 |
| 2023/0041683 | A1* | 2/2023 | Paton | A63B 67/02 |
| 2023/0080262 | A1* | 3/2023 | Håknsson | F16B 5/0614 403/375 |

* cited by examiner

GOLF PRACTICE APPARATUS

FIELD OF THE INVENTION

The present invention relates to a golf practice apparatus, and more particularly, a golf practice apparatus for putting and short-game practice.

BACKGROUND OF THE INVENTION

The sport of golf is one of the most popular recreational sports in the world. Unfortunately, most cannot enjoy playing the game of golf whenever the desire arises. First, one may need to travel quite some distance to their nearest golf course or the golf course of their choice. Second, tee time fees may quickly add up, membership dues may be cost prohibitive to many enthusiasts of the sport, or that the course and driving range are all booked up. Third, while many golf courses have a practice putting green, there are many golf courses that do not have a short-game driving range, or may charge a fee to practice short games. While some golf courses have driving ranges that are also setup to practice short-game skills, one still needs to find and head out to those golf courses, and ball fees are increasing. So, golf enthusiasts (e.g. golfers) may sign up for tee times sparingly. To avoid any regression in their game, or to improve their skills, golfers need to practice different aspects of their games regularly in the convenience of their homes, offices, or any other indoor or outdoor spaces away from the golf course.

Therefore, to solve the above problems, various embodiments of a golf practice apparatus for putting and short-game practice (e.g. chipping, pitching, approaching and the like) is provided, as there is a need for a device that accomplishes this goal. This invention is directed to solve these problems and satisfy the long-felt need.

SUMMARY OF THE INVENTION

The present invention contrives to solve the disadvantages of the prior art. The present invention provides a golf practice apparatus for putting and short-game practice that is constructed to be easy for the user to setup and use.

The object of the invention is to provide a golf practice apparatus for putting and short game practices, including a base which includes a green portion, a hole, and a coupling groove; a mat which includes a first end portion and a second end portion, wherein the second end portion is attached to the base; and a target assembly that includes a netting, a frame, and a connecting member. The coupling groove of the base and the connecting member of the target assembly are constructed such that the connecting member is removably received in the coupling groove to secure the target assembly to the base.

Another object of the invention is to provide a golf practice apparatus for putting and short game practices, including a base which includes a green portion, a hole, and first and second coupling groove; a mat which includes a first end portion and a second end portion, wherein the second end portion is attached to the base; and a target assembly that includes a netting, a frame, and first and second connecting members. The first and second coupling grooves of the base and the connecting members of the target assembly are constructed such that the first and second connecting members are respectively and removably received in the first and second coupling grooves to secure the target assembly to the base.

Yet another object of the invention is to provide a golf practice apparatus for putting and short game practices, including a base which includes a green portion, a hole, and first and second coupling groove; a mat which includes a first end portion and a second end portion, wherein the second end portion is attached to the base; and a target assembly that includes a netting, and a frame. The frame comprises a top bar, a first side bar, a second side bar, and first and second "L"-shaped bottom bars. The first and second coupling groove of the base and the first and second "L"-shaped bottom bars are constructed such that the first and second "L"-shaped bottom bars are respectively and removably received in the first and second coupling grooves to secure the target assembly to the base.

The advantages of the present invention are: (1) convenient and easy setup of the golf practice apparatus for putting and short-game practice (e.g. pitching, chipping, etc.); (2) the ability for the user to work on multiple portions of the game of golf (putting and short-game practice) using just one golf practice apparatus of the present invention; (3) few number of parts and materials to set up the golf practice apparatus of the present invention for practice sessions, which allows the user to quickly and conveniently assemble and dissemble while spending more of their time practicing their golf game; (4) small number of parts that do not take up much space means that the golf practice apparatus of the present invention and its various embodiments can be easily transported (i.e. portable) and stored; (5) the employment of a netting of various sizes prevents damage to nearby furnishings and fixtures; (6) a convenient ball return mechanism such that the same ball can be reused again quickly and conveniently (less time wasted in trying retrieve the ball from the golf practice apparatus); (7) alternating practice between one's putting game or short-game using the same apparatus; (8) a presence of a side netting to direct hook, slice, angled, mishit, or any other types of shots towards the ball return mechanism; (9) inclusion of a chipping mat to practice one's golf game on various lies (uphill, downhill, slice, and hook lies); and (10) the ability to practice one's golf game anywhere (e.g. office, outdoors, living room, bedroom, etc.) at any time.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF EMBODIMENTS OF THE INVENTION

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1:
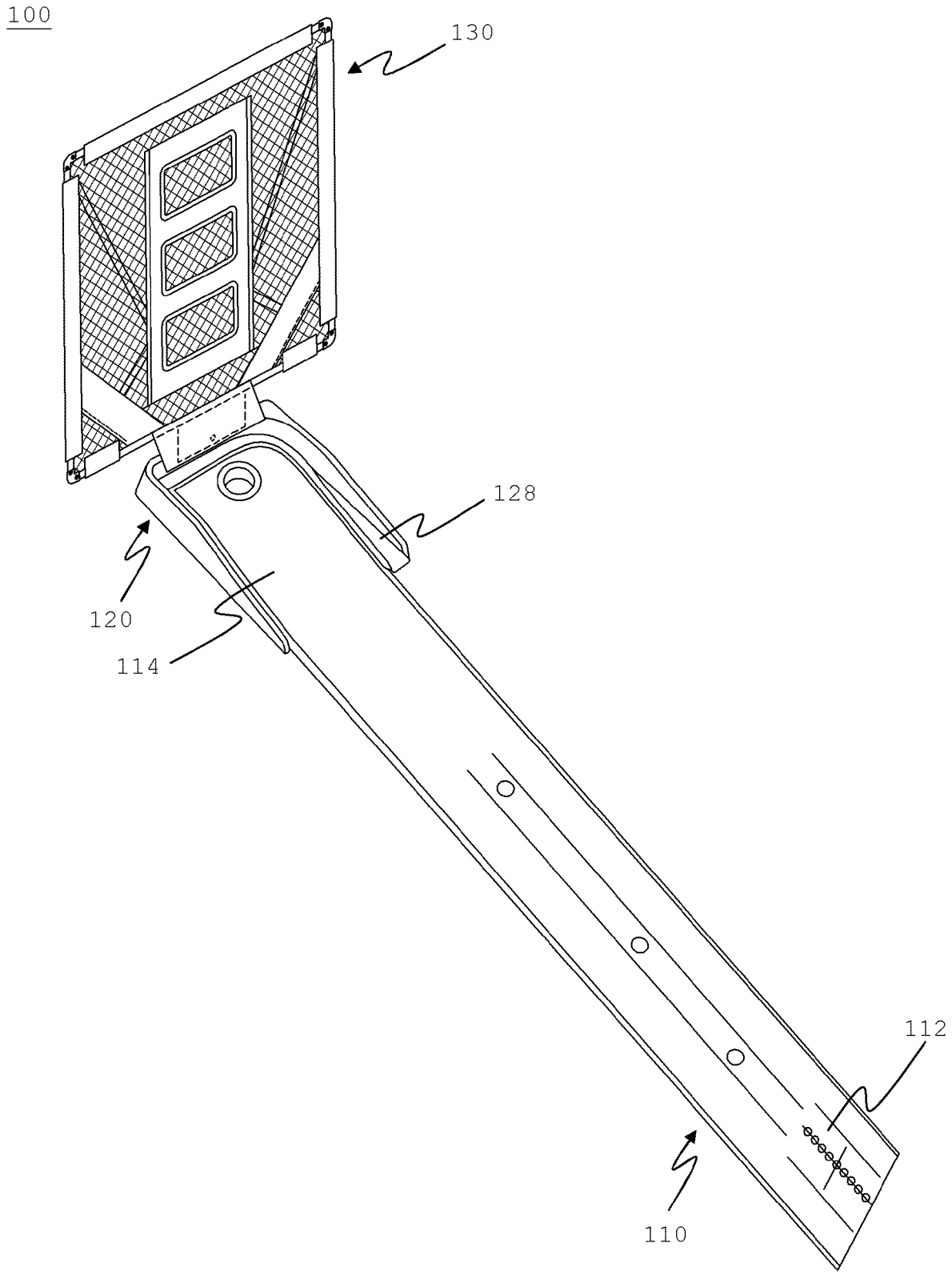
FIG. 1 shows a perspective view of the golf practice apparatus according to embodiments of the present invention.

FIG. 1 shows a golf practice apparatus (100) for putting and short game practices. The first embodiment of the present invention is a golf practice apparatus (100) which includes a base (120) which includes a green portion (122), a hole (124), and a coupling groove (126); a mat (110) which includes a first end portion (112) and a second end portion (114), the second end portion (114) being attached to the base (120); and a target assembly (130) that includes a netting (131), a frame (132), and a connecting member (133). As shown, the first end portion (112) is for putting a golf ball and the second end portion (114) is either removably or fixedly attached to the base (120), preferably to a green portion (122) of the base (120). As shown, the coupling groove (126) of the base (120) and the connecting member (133) of the target assembly (130) are constructed such that the connecting member (133) is removably received in the coupling groove (126) to secure the target assembly (130) to the base (120). The netting (131) may be made any of the following materials: natural or synthetic fabric materials; elastic materials; fiberglass; thin or thick plastic material such as those found in tents; and the like.

Figure 2:
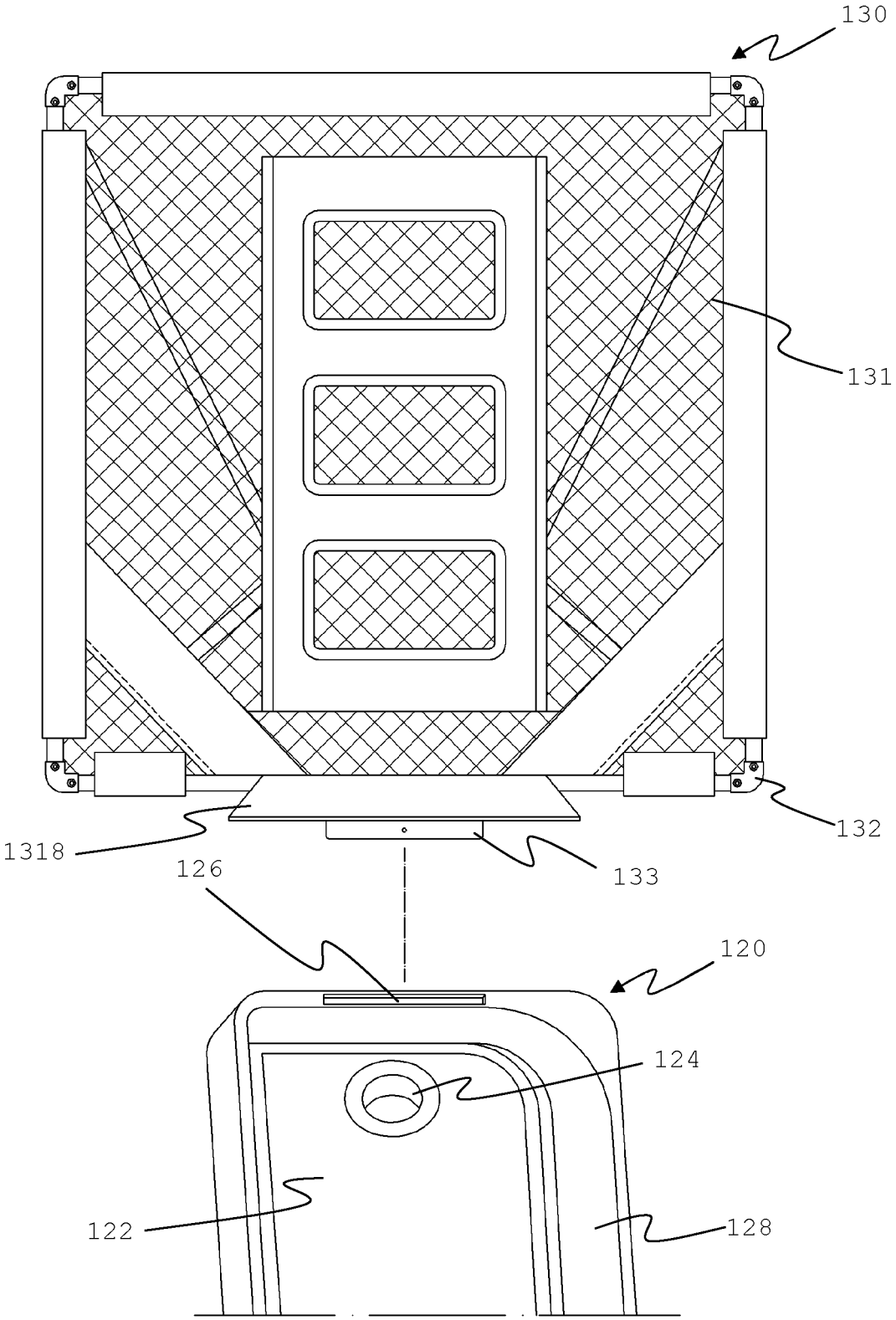
FIG. 2 shows a partial exploded view thereof according to embodiments of the present invention.
Figure 3A:
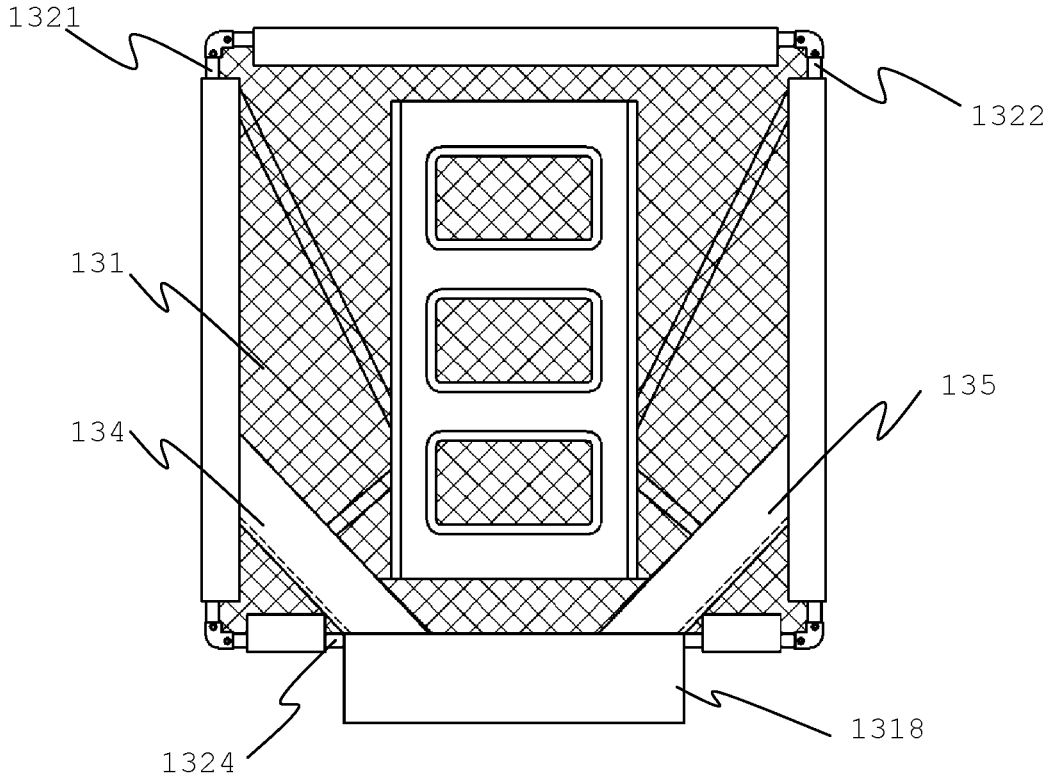
FIGS. 3A and 3B show front and rear plan views of a target assembly thereof according to embodiments of the present invention.
Figure 3B:
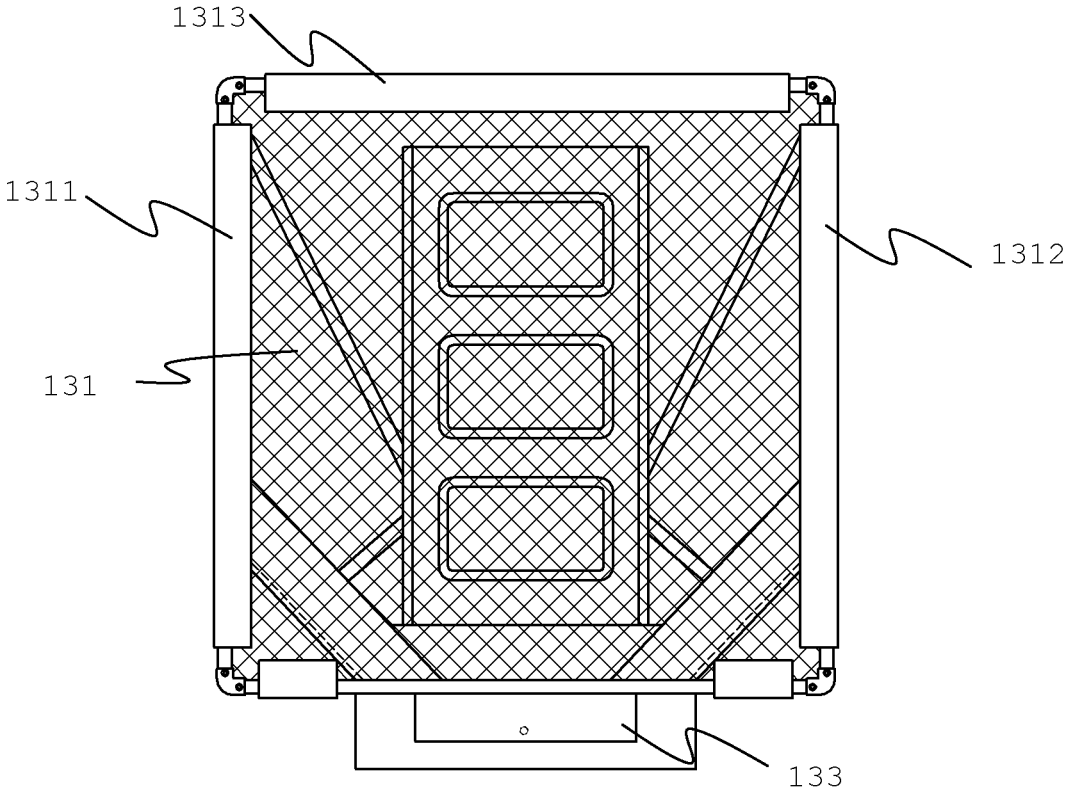
Figure 4A:
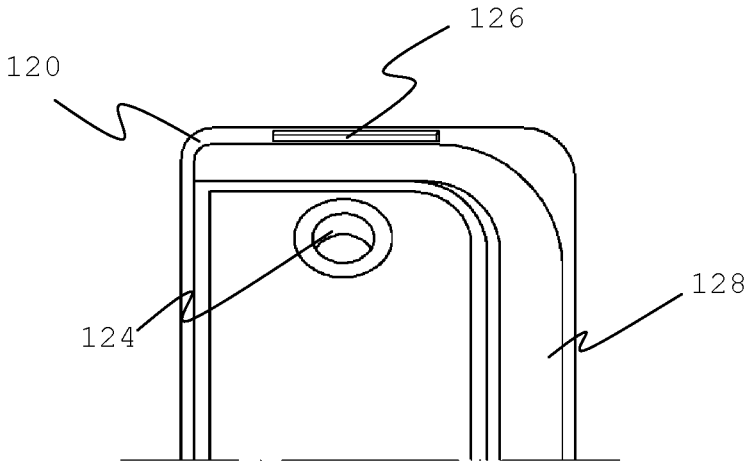
FIGS. 4A and 4B show partial views of a base thereof according to embodiments of the present invention.
Figure 5:
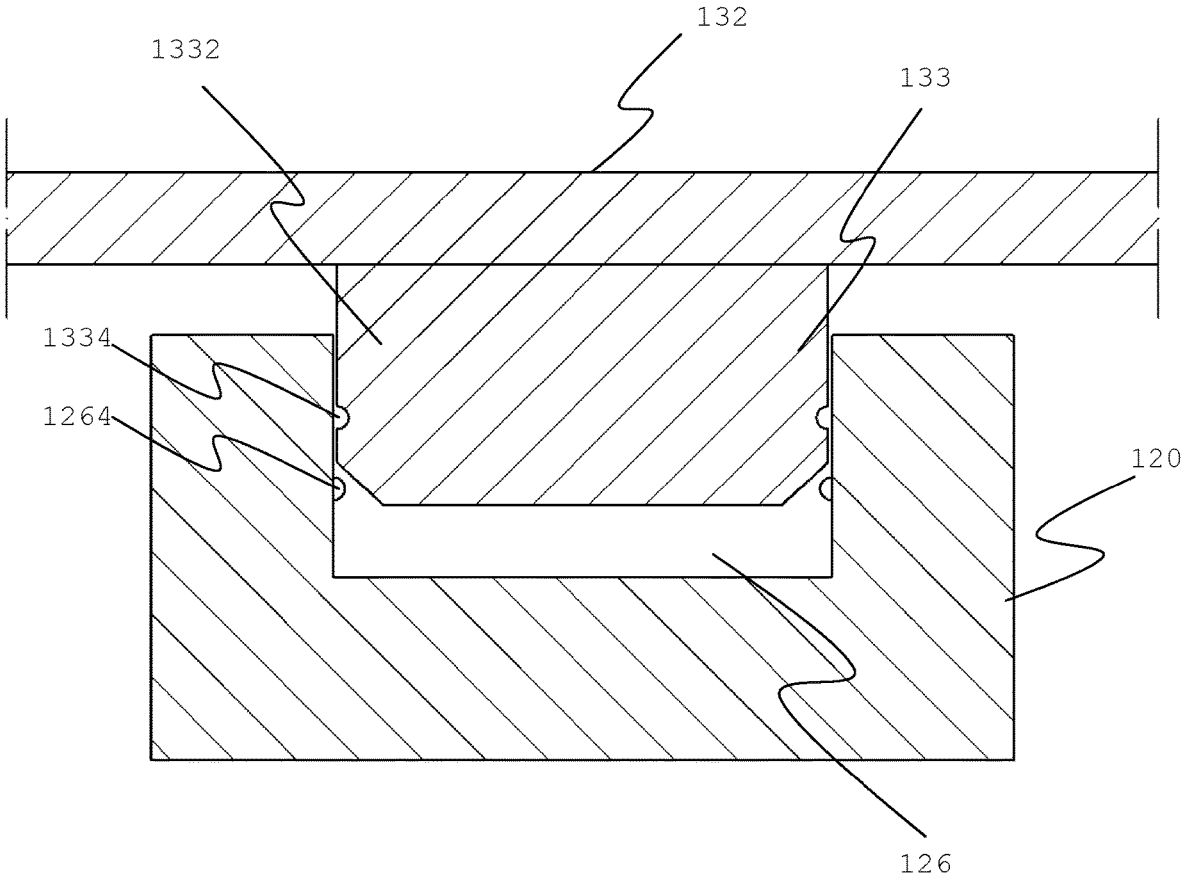
FIG. 5 shows a partial cross-sectional view thereof according to embodiments of the present invention.

The connecting member (133) of the target assembly (130) as shown in FIGS. 2 and 3A-B may include a flat plate (1332) fixedly attached to the frame (132). With the flat plate (1332) included in the connecting member (133) of the target assembly (130), the coupling groove (126) of the base (120) shown in FIG. 4A may be a slot to receive the flat plate (1332) therein as shown in FIG. 5. Also shown in FIG. 5, to further secure the target assemble to the base (120), the connecting member (133) of the target assembly (130) may further include a groove (1334) and a slanted part (1335). The coupling groove (126) of the base (120) may further include a protrusion (1264) so that the protrusion (1264) is removably received in the groove (1334). The groove (1334) is preferably sized to receive the protrusion (1264) therein, the type of coupling may be a snap-fit coupling. The protrusion (1264) may be substantially semi-spherical. Alternatively, the protrusion (1264) may extend substantially longitudinally or lengthwise and the groove (1334) would be complimentary to the shape of this protrusion variation for proper fit and alignment of the target assembly (130) and the base (120) as shown. For more of a secure fit, the base (120) may include two coupling grooves (126) and two protrusions (1264) on both sides of the coupling groove (126).

Figure 6A:
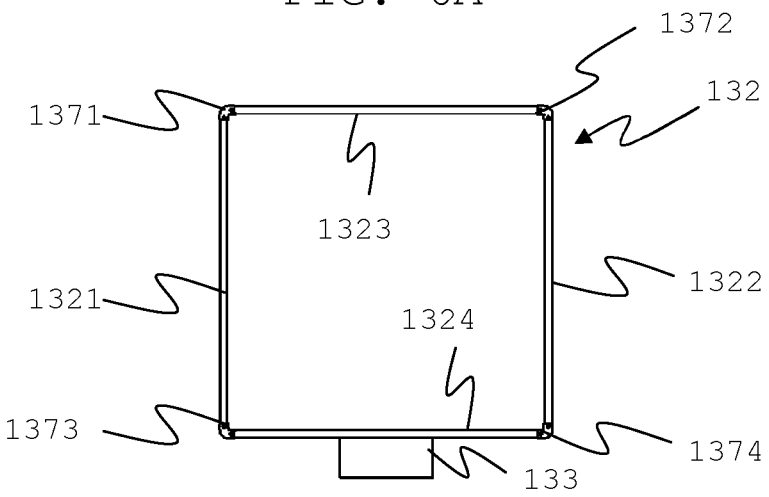
FIG. 6A-C show views of frames of various embodiments thereof.

As for the construction of the target assembly (130), the frame (132) of the target assembly (130) shown in FIG. 6A may further include a top bar (1323), a bottom bar (1324), a first side bar (1321), and a second side bar (1322) wherein the connecting member (133) is fixedly attached to or extended from the bottom bar (1324). Here, the connecting member (133) is fixedly attached to or extended from the bottom bar (1324).

As for the materials used to construct the golf practice apparatus (100), the flat plate (1332) of the golf practice apparatus (100) may be made of plastic, polyvinyl chloride, steel or steel, titanium, fiber glass, carbon fiber, or other like materials. For the frame (132) of the target assembly (130), the top bar (1323), the bottom bar (1324), the first side bar (1321), and the second side bar (1322) are made of plastic, polyvinyl chloride, steel or steel, titanium, fiber glass, carbon fiber, or other like materials.

Figure 7A:
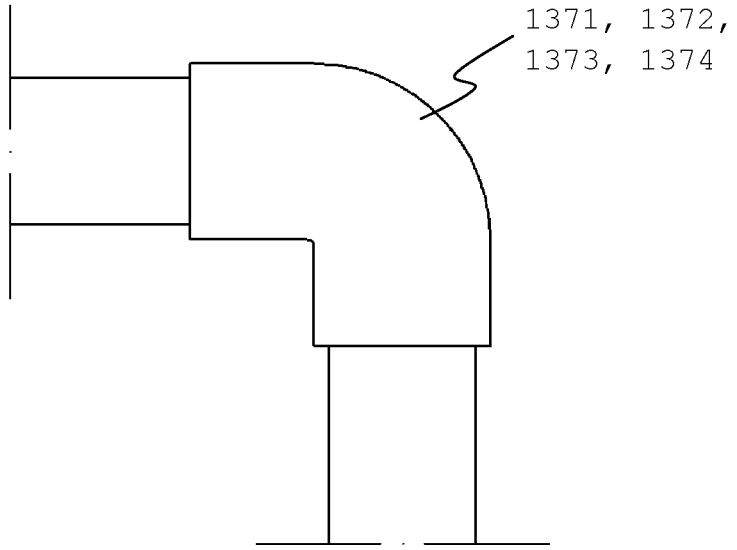
FIGS. 7A and 7B show partial views of the frame thereof according to embodiments of the present invention.
Figure 7B:
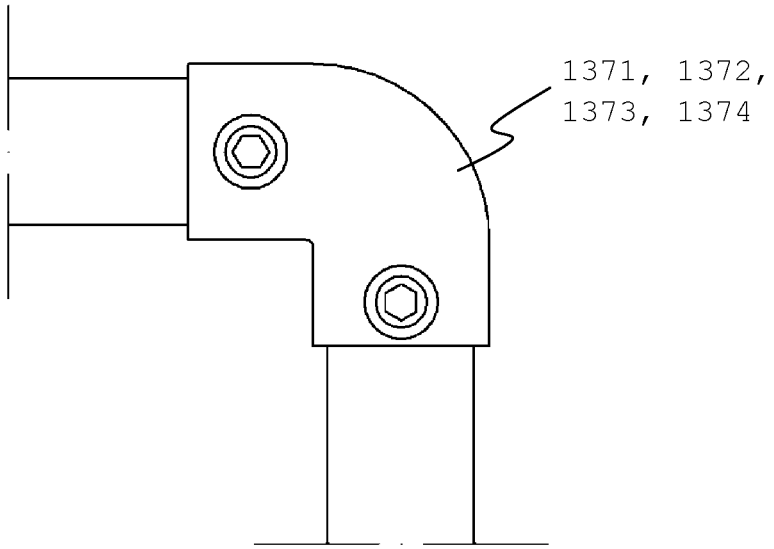

Additionally, the frame (132) of the target assembly (130) may further include first, second, third, and fourth "L"-shaped connecting parts (1371, 1372, 1373, 1374) as shown in FIGS. 6A and FIGS. 7A-B. The first "L"-shaped connecting part (1371) connects the top bar (1323) to the first side bar (1321). The second "L"-shaped connecting part (1372) connects the top bar (1323) to the second side bar (1322). The third "L"-shaped connecting part (1373) connects the first side bar (1321) to the bottom bar (1324). The fourth "L"-shaped connecting part (1374) connects the second side bar (1322) to the bottom bar (1324). Preferably, the "L"-shaped connecting part is a two-way elbow fitting connecter as shown. The first, second, third, and fourth "L"-shaped connecting parts (1371, 1372, 1373, 1374) have substantially same structure and sizes. The respective "L"-shaped connecting parts may receive ends of the respective bars in a snug fit via openings on either ends of the "L"-shaped connecting part. Furthermore, the "L"-shaped connecting parts may include a screw- or a screw-nut-tightening system as shown to further secure the ends of the respective bars in the "L"-shaped connecting parts. Once the end of the respective bar is fitted into the opening of one end of the "L"-shaped connecting part, the screw- or the screw-nut tightening system may be adjusted by an appropriate screwdriver, hextool, or the like that pushes a screw inwards towards to the end of the bar received therein the "L"-shaped connecting part.

For easy and convenient assembly of the target assembly (130) of the golf apparatus, the top bar (1323), the first side bar (1321), and the second side bar (1322) have substantially the same structure and sizes. The top bar (1323), the bottom bar (1324), the first side bar (1321), and the second side bar (1322) being made of plastic, polyvinyl chloride, steel or steel, titanium, fiber glass, carbon fiber, or other like materials that can be used to construct the bars of the target assembly (130) that are substantially uniform in structure and size. Likewise, the first, second, third, and fourth "L"-shaped connecting parts (1371, 1372, 1373, 1374) may have substantially same structure and size to facilitate the assembly of the target assembly (130). Alternatively, the top bar (1323) and the bottom bar (1324) are substantially uniform in structure and size, and the first and second side bars (1321, 1322) are substantially uniform in structure and size such that the target assembly (130), when assembled, may be a wide shape or a tall shape.

The base (120) may further include a ball guide channel (128) at least partially formed along a bottom bar (1324) of the frame (132) as shown in FIG. 1. If the base (120) includes a ball guide channel (128), the target assembly (130) may further include a first ball guiding member (134) which is attached to the netting (131) diagonally between the first side bar (1321) and the bottom bar (1324) as shown in FIG. 2. The ball guide channel (128) is constructed to return a ball to the user following a practice shot. The ball guiding members of the target assembly (130) is constructed to direct the falling ball to the ball guide channel (128), which then returns the ball to the user to be used for a subsequent practice shot such that the same ball may be used for subsequent practice shots.

Figure 9:
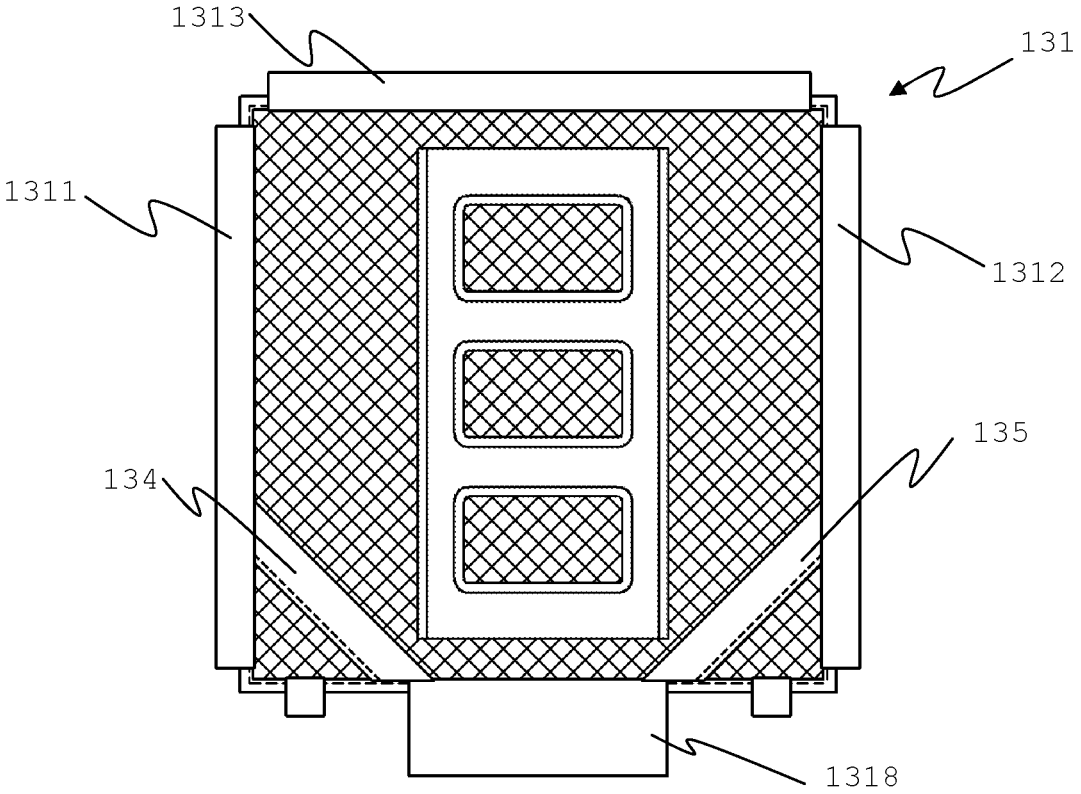
FIG. 9 shows a target assembly thereof according to embodiments of the present invention.

Additionally, again for practice shots, the target assembly (130) may further include a second ball guiding member (135). This second ball guiding member (135) is attached to the netting (131) diagonally between the second side bar (1322) and the bottom bar (1324). Furthermore, the second ball guiding member (135) is constructed to direct the falling ball to the ball guide channel (128) of the base (120), which then returns the ball to the user for a subsequent practice shot. The netting (131) of the golf practice apparatus (100) may include a top sleeve (1313), a first side sleeve (1311), and a second side sleeve (1312). As shown in FIG. 9, the netting (131) is associated with the frame (132) of the target assembly (130) with a top bar (1323) of the frame (132) received in the top sleeve (1313), a first side bar (1321) of the frame (132) received in the first side sleeve (1311), and a second side bar (1322) of the frame (132) is received in the second side sleeve (1312). The first and second ball guiding members (134, 135) may be constructed from any of the following materials: natural or synthetic fabric materials; elastic materials; fiberglass; thin or thick plastic material such as those found in tents; and the like.

The top, first side, and second side sleeves (1313, 1311, 1312) each have an internal cavity and two ends, the two ends are preferably constructed to be open. The top, first side, and second side sleeves (1313, 1311, 1312) may be constructed to open lengthwise to permit the top, first side, and second side bars (1323, 1321, 1322) to be placed in the top, first side, and second side sleeves (1313, 1311, 1312) respectively. Included on the lengthwise portions of the sleeves are complimentary fasteners, examples of fasteners that may be found on the sleeves include, but are not limited to, hook and loop fasteners, button fasteners, a zipper system, snap fasteners, grommet fasteners, magnet fasteners, and the like. Alternatively, the sleeves may be closed lengthwise where the top, first side, and second side bars (1323, 1321, 1322) slide into the internal cavity of the top, first side, and second side sleeves (1313, 1311, 1312) respectively using the open ends of the sleeves. As for materials used in their construction, the top, first side, and second side sleeves (1313, 1311, 1312) made from natural or synthetic fabric materials or materials such as leather for added strength and longevity to support the target assembly (130) across numerous sessions with the golf practice apparatus (100).

Figure 8:
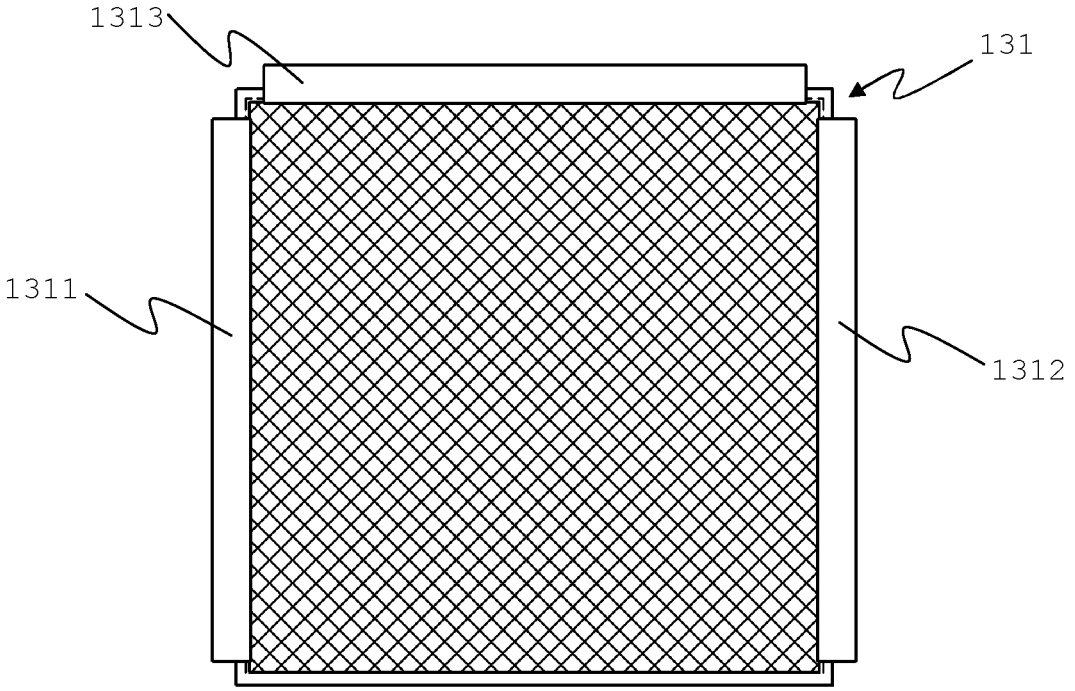
FIG. 8 shows a netting thereof according to embodiments of the present invention.

The netting (131) may be stitched onto the top, first side, and second side sleeves (1313, 1311, 1312) as shown in FIGS. 8 and 9. If the netting (131) is stitched onto the top, first side, and second side sleeves (1313, 1311, 1312), then the sleeves are constructed to open lengthwise and include fasteners, preferably fasteners like the snap fasteners, grommet fasteners, button fasteners, magnet fasteners, hoop and loop fasteners, and the like such that the sleeves may receive the top, first side, and second side bars (1323, 1321, 1322) having the netting (131) stitched thereon and close the sleeves using the fasteners joining together through openings of the netting (131).

The netting (131) further includes a flap (1318) shown in FIG. 3A-B that is downwardly extended over a bottom bar (1324) of the frame (132) to guide a falling ball to the ball guide channel (128). A diagonal attachment between the first ball guiding member (134) and the netting (131) extends from the first side bar (1321) to the bottom bar (1324) on or about the flap (1318) or within the flap (1318) such that the first ball guiding member (134) is substantially contiguous with the flap (1318). This construction permits the ball to roll down the first ball guiding member (134) to the flap (1318), then to the ball guide channel (128) of the base (120), and then to the user. Similarly, a diagonal attachment between the second ball guiding member (135) and the netting (131) extends from the second side bar (1322) to the bottom bar (1324) on or about the flap (1318) or within the flap (1318) such that the second ball guiding member (135) is substantially contiguous with the flap (1318). This construction similarly permits the ball to roll down the second ball guiding member (135) to the flap (1318), then to the ball guide channel (128) of the base (120), and then to the user. As shown, the diagonal attachments may be achieved via stitching the netting (131) to the first and second ball guiding members (134, 135), which prevents the ball from going to some location other than towards the ball guide channel (128) of the base (120). A portion of the flap (1318) may include a hook and loop fastener to removably attach the portion of the flap (1318) with the base (120).

Figure 10:
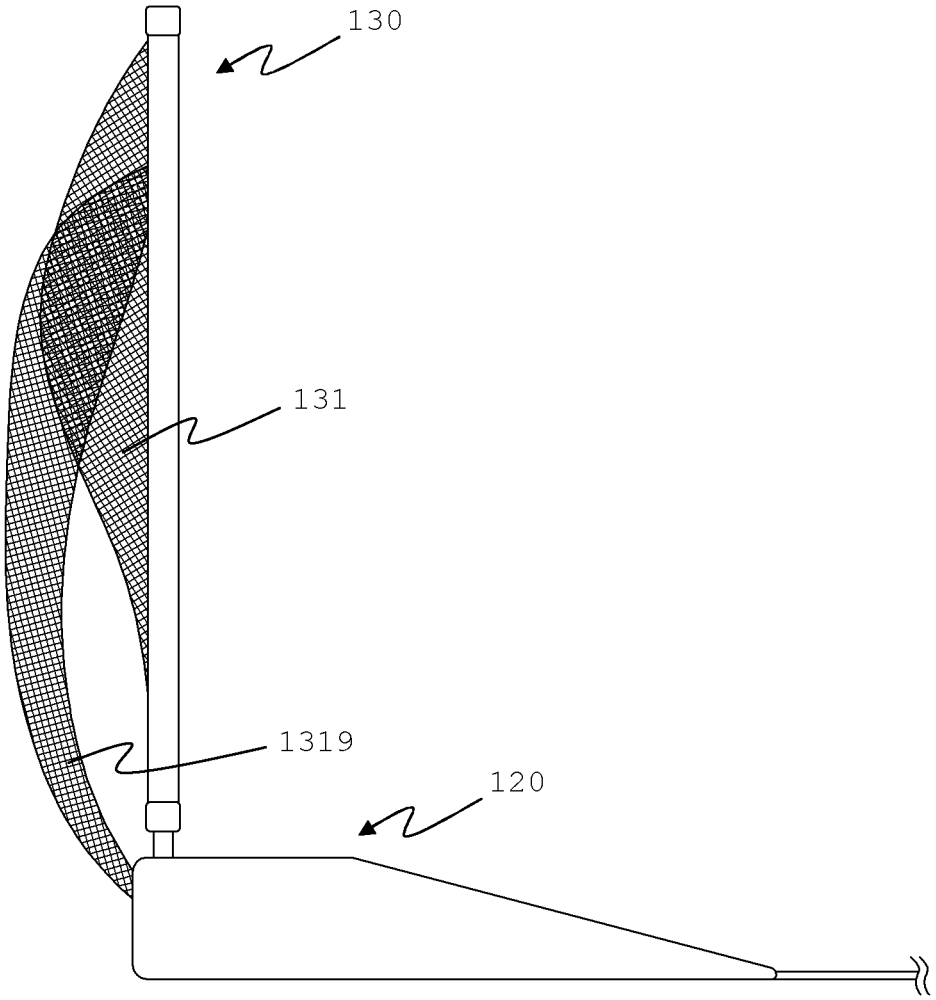
FIG. 10 shows a partial side view of the golf practice apparatus according to embodiments of the present invention.

The netting (131) may further include a pouch (1319) that may be directly or indirectly connected to the ball guide channel (128). As shown in FIG. 10, the pouch (1319) is made from a similar material as the netting (131). Furthermore, the pouch (1319) is preferably constructed to connect to the ball guide channel (128) of the base (120) directly. When the user strikes a ball and the ball lands in the pouch (1319), the ball rolls down therein the pouch (1319) as shown. The pouch (1319) guides the ball to a rear opening in the base (120) that empties the ball into the ball channel guide (128) and then back to the user. The pouch (1319) of the netting (131) may be a plurality of pouches each emptying into the ball guide channel (128) of the base (120) directly.

Alternatively, the netting (131) may simply be a hitting screen without any ball-sized openings. The hitting screen is preferably made from thin or thick plastic material such as those found in tents, and the hitting screen is constructed to withstand the impact from the golf ball. The hitting screen may be stitched onto the top, first side, and second side sleeves (1313, 1311, 1312). If the screen is stitched onto the top, first side, and second side sleeves (1313, 1311, 1312), then the sleeves are constructed to open lengthwise to form a channel to receive the top, first side, and second side bars (1323, 1321, 1322). Alternatively, rather than having the hitting screen stitched onto the top, first side, and second side sleeves (1331, 1311, 1312), the hitting screen may include fasteners that are complimentary to fasteners on the sleeves. These fasteners may be constructed to be like snap fasteners, grommet fasteners, button fasteners, magnet fasteners, hoop and loop fasteners, and the like.

As shown in FIG. 9, the target assembly (130) may include a targeting sheet that overlays a portion of the netting (131). The targeting sheet includes at least one pouch (1319). The targeting sheet may be constructed to hold multiple pouches that are arrayed to form a set of targets for the golf ball. The targeting sheet may further include graphics, logos, text, or the combination of any two or three of them. These graphics, logos, and/or text may include visually stimulating graphics, instructions to hit the golf ball, or even rules for a putting game to be played by the user or a group of users.

The green portion (122) includes a top and a bottom with the top including synthetic lawn made from materials like polyethylene or monofilament polyethylene blend fibers to mimic grassy greens typically found in golf courses. The bottom of the green portion (122) is made from synthetic material as well, preferably synthetic rubber and the like for its pliability and grip on many surfaces, other pliant synthetic materials may be used. When the user is finished with their putting practice or putting game for the day, the user can easily dissemble the target assembly (130) and the mat (110) from the base (120) and roll up the mat (110) to be stored.

Figure 4B:
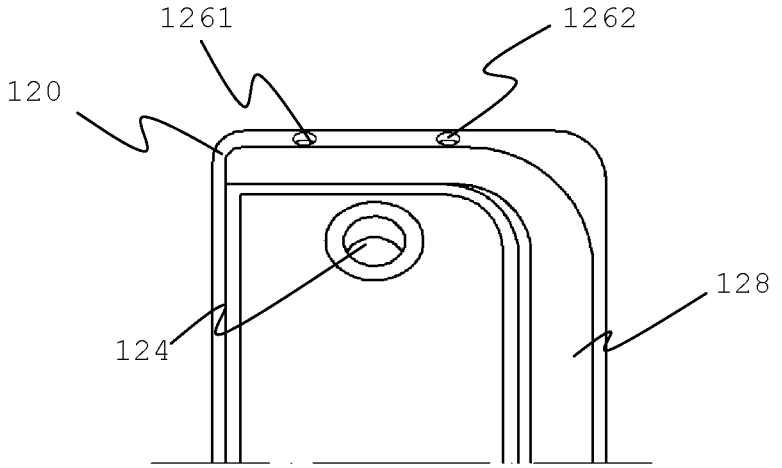
Figure 6B:
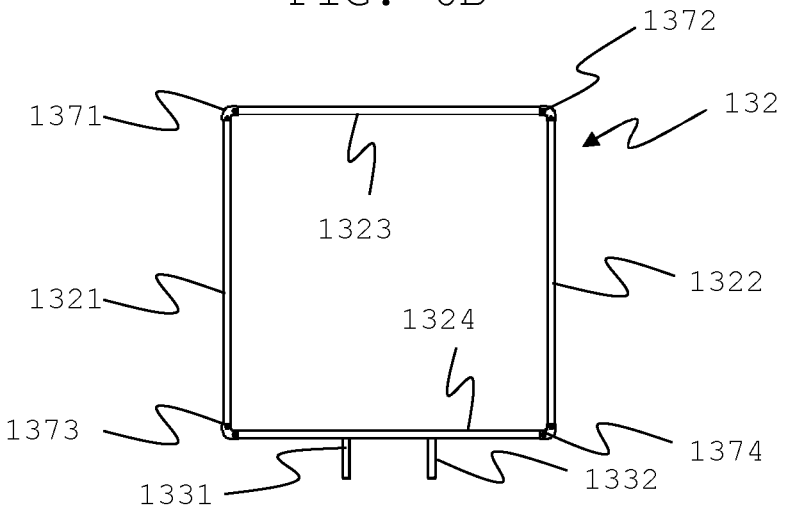

In a second embodiment of the present invention shown in FIGS. 1, 4B, and 6B, a golf practice apparatus (100) for putting and short game practices, includes a base (120) that includes a green portion (122), a hole (124), and first and second coupling grooves (1261, 1262); a mat (110) which includes a first end portion (112) and a second end portion (114), wherein the second end portion (114) is attached to the base (120); and a target assembly (130) that includes a netting (131), a frame (132), and first and second connecting members (1331, 1332). The first and second coupling grooves (1261, 1262) of the base (120) shown in FIG. 4B and the connecting members (1331, 1332) of the target assembly (130) shown in FIG. 6B are constructed such that the first and second connecting members (1331, 1332) are respectively and removably received in the first and second coupling grooves (1261, 1262) to secure the target assembly (130) to the base (120). The netting (131) may be made any of the following materials: natural or synthetic fabric materials; elastic materials; fiberglass; thin or thick plastic material like those found in tents; and the like.

The frame (132) of the target assembly (130) includes a top bar (1323), a bottom bar (1324), a first side bar (1321), and a second side bar (1322). The first and second connecting members (1331, 1332) are fixedly attached to or extended from the bottom bar (1324). As shown in FIG. 6B, the first and second connecting members (1331, 1332) are constructed to project as longitudinal protrusions from the bottom bar (1324) of the frame (132) of the target assembly (130) where the first connecting member (1331) is removably received in the first coupling groove (126) and the second connecting member (1332) is removably received in the second coupling groove (126).

Likewise to the first embodiment, the materials used to construct the top bar (1323), the bottom bar (1324), the first side bar (1321), and the second side bar (1322) are plastic, polyvinyl chloride, steel or steel, titanium, fiber glass, carbon fiber, or other like materials.

Additionally, the frame (132) of the target assembly (130) may further include first, second, third, and fourth "L"-shaped connecting parts (1371, 1372, 1373, 1374) as described earlier. The first "L"-shaped connecting part (1371) connects the top bar (1323) to the first side bar (1321). The second "L"-shaped connecting part (1372) connects the top bar (1323) to the second side bar (1322). The third "L"-shaped connecting part (1373) connects the first side bar (1321) to the bottom bar (1324). The fourth "L"-shaped connecting part (1374) connects the second side bar (1322) to the bottom bar (1324). Preferably, the "L"-shaped connecting part is a two-way elbow fitting connecter as shown. The first, second, third, and fourth "L"-shaped connecting parts (1371, 1372, 1373, 1374) have substantially same structure and sizes. The respective "L"-shaped connecting parts may receive ends of the respective bars in a snug fit via openings on either ends of the "L"-shaped connecting part. Furthermore, the "L"-shaped connecting parts may include a screw- or a screw-nut-tightening system as shown to further secure the ends of the respective bars in the "L"-shaped connecting parts. Once the end of the respective bar is fitted into the opening of one end of the "L"-shaped connecting part, the screw- or the screw-nut tightening system may be adjusted by an appropriate screwdriver, hextool, or the like that pushes a screw inwards towards to the end of the bar received therein the "L"-shaped connecting part.

For easy and convenient assembly of the target assembly (130) of the golf apparatus, the top bar (1323), the first side bar (1321), and the second side bar (1322) have substantially the same structure and sizes. The top bar (1323), the bottom bar (1324), the first side bar (1321), and the second side bar (1322) being made of plastic, polyvinyl chloride, steel or steel, titanium, fiber glass, carbon fiber, or other like materials that can be used to construct the bars of the target assembly (130) that are substantially uniform in structure and size. Likewise, the first, second, third, and fourth "L"-shaped connecting parts (1371, 1372, 1373, 1374) may have substantially same structure and size to facilitate the assembly of the target assembly (130). Alternatively, the top bar (1323) and the bottom bar (1324) are substantially uniform in structure and size, and the first and second side bars (1321, 1322) are substantially uniform in structure and size such that the target assembly (130), when assembled, may be a wide shape or a tall shape.

The base (120) may further include a ball guide channel (128) at least partially formed along a bottom bar (1324) of the frame (132). The ball guide channel (128) is constructed to return the ball to the user. The target assembly (130) may further include first and second ball guiding members (134, 135); the first and second ball guiding members (134, 135) may be construct from any of the following materials: natural or synthetic fabric materials, elastic materials, fiberglass, and the like. The first ball guiding member (134) is attached to the netting (131) diagonally between the first side bar (1321) and the bottom bar (1324), and the second ball guiding member (135) is attached to the netting (131) diagonally between the second side bar (1322) and the bottom bar (1324). Once the golf ball is struck by the user and lands on the netting (131), the ball rolls down the net and encounters either the first and second ball guiding members (134, 135) that are constructed to direct the falling ball to the ball guide channel (128), which then returns the ball to the user for a subsequent practice shot. The netting (131) of the golf practice apparatus (100) may include a top sleeve (1313), a first side sleeve (1311), and a second side sleeve (1312). As shown, the netting (131) is associated with the frame (132) of the target assembly (130) with a top bar (1323) of the frame (132) received in the top sleeve (1313), a first side bar (1321) of the frame (132) received in the first side sleeve (1311), and a second side bar (1322) of the frame (132) is received in the second side sleeve (1312).

The top, first side, and second side sleeves (1313, 1311, 1312) each have an internal cavity and two ends, the two ends are preferably constructed to be open. The top, first side, and second side sleeves (1313, 1311, 1312) may be constructed to open lengthwise to permit the top, first side, and second side bars (1323, 1321, 1322) to be placed in the top, first side, and second side sleeves (1313, 1311, 1312) respectively. Included on the lengthwise portions of the sleeves are complimentary fasteners, examples of fasteners that may be found on the sleeves include, but are not limited to, hook and loop fasteners, button fasteners, a zipper system, snap fasteners, grommet fasteners, magnet fasteners, and the like. Alternatively, the sleeves may be closed lengthwise where the top, first side, and second side bars (1323, 1321, 1322) slide into the internal cavity of the top, first side, and second side sleeves (1313, 1311, 1312) respectively using the open ends of the sleeves. As for materials used in their construction, the top, first side, and second side sleeves (1313, 1311, 1312) made from natural or synthetic fabric materials or materials such as leather for added strength and longevity to support the target assembly (130) across numerous sessions with the golf practice apparatus (100).

The netting (131) may be stitched onto the top, first side, and second side sleeves (1313, 1311, 1312) as shown. If the netting (131) is stitched onto the top, first side, and second side sleeves (1313, 1311, 1312), then the sleeves are constructed to open lengthwise and include fasteners, preferably fasteners like the snap fasteners, grommet fasteners, button fasteners, magnet fasteners, hoop and loop fasteners, and the like such that the sleeves may receive the top, first side, and second side bars (1323, 1321, 1322) having the netting (131) stitched thereon and close the sleeves using the fasteners joining together through openings of the netting (131).

The netting (131) further includes a flap (1318) that is downwardly extended over a bottom bar (1324) of the frame (132) to guide a falling ball to the ball guide channel (128). A diagonal attachment between the first ball guiding member (134) and the netting (131) extends from the first side bar (1321) to the bottom bar (1324) on or about the flap (1318) or within the flap (1318) such that the first ball guiding member (134) is substantially contiguous with the flap (1318). This construction permits the ball to roll down the first ball guiding member (134) to the flap (1318), then to the ball guide channel (128) of the base (120), and then to the user. Similarly, a diagonal attachment between the second ball guiding member (135) and the netting (131) extends from the second side bar (1322) to the bottom bar (1324) on or about the flap (1318) or within the flap (1318) such that the second ball guiding member (135) is substantially contiguous with the flap (1318). This construction similarly permits the ball to roll down the second ball guiding member (135) to the flap (1318), then to the ball guide channel (128) of the base (120), and then to the user. As shown, the diagonal attachments may be achieved via stitching the netting (131) to the first and second ball guiding members (134, 135), which prevents the ball from going to some location other than towards the ball guide channel (128) of the base (120). A portion of the flap (1318) may include a hook and loop fastener to removably attach the portion of the flap (1318) with the base (120).

The netting (131) may further include a pouch (1319) that may be directly or indirectly connected to the ball guide channel (128). As shown in FIG. 10, the pouch (1319) is made from a similar material as the netting (131). Furthermore, the pouch (1319) is preferably constructed to connect to the ball guide channel (128) of the base (120) directly. When the user strikes a ball and the ball lands in the pouch (1319), the ball rolls down therein the pouch (1319) as shown. The pouch (1319) guides the ball to a rear opening in the base (120) that empties the ball into the ball channel guide (128) and then back to the user. The pouch (1319) of the netting (131) may be a plurality of pouches each emptying into the ball guide channel (128) of the base (120) directly.

The target assembly (130) may include a targeting sheet that overlays a portion of the netting (131). The targeting sheet includes at least one pouch (1319). The targeting sheet may be constructed to hold multiple pouches that are arrayed to form a set of targets for the golf ball. The targeting sheet may further include graphics, logos, text, or the combination of any two or three of them. These graphics, logos, and/or text may include visually stimulating graphics, instructions to hit the golf ball, or even rules for a putting game to be played by the user or a group of users.

The green portion (122) includes a top and a bottom with the top include synthetic lawn made from materials like polyethylene or monofilament polyethylene blend fibers to mimic grassy greens typically found in golf courses. The bottom of the green portion (122) is made from synthetic material as well, preferably synthetic rubber and the like for its pliability and grip on many surfaces, other pliant synthetic materials may be used. When the user is finished with their putting practice or putting game for the day, the user can easily dissemble the target assembly (130) and the mat (110) from the base (120) and roll up the mat (110) to be stored.

Figure 6C:
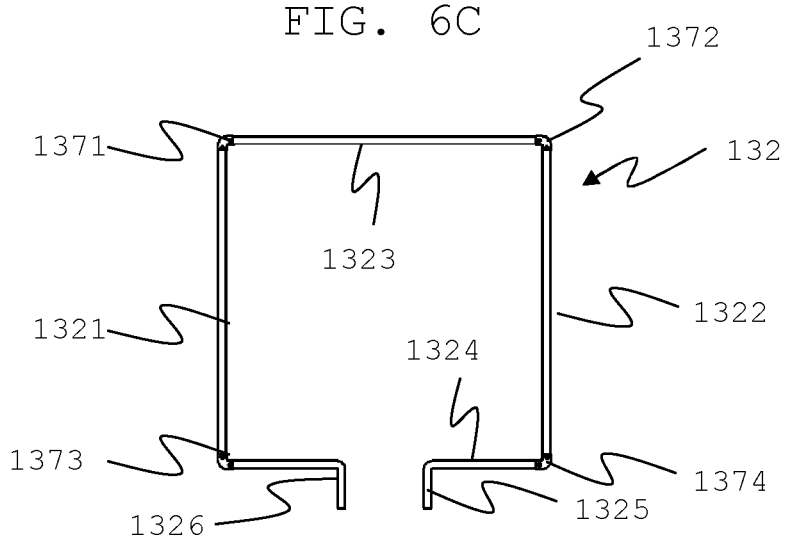

In a third embodiment of the present invention shown in FIGS. 1, 4B, and 6C, a golf practice apparatus (100) for putting and short game practice, includes a base (120) which includes a green portion (122), a hole (124), and first and second coupling grooves (1261, 1262) shown in FIG. 4B; a mat (110) which includes a first end portion (112) and a second end portion (114), wherein the second end portion (114) is attached to the base (120); and a target assembly (130) that includes a netting (131) and a frame (132). The frame (132) comprises a top bar (1323), a first side bar (1321), a second side bar (1322), and first and second "L"-shaped bottom bars (1325, 1326) shown in FIG. 6C. The first and second coupling grooves (1261, 1262) of the base (120) shown in FIG. 4B and the first and second "L"-shaped bottom bars (1325, 1326) are constructed such that the first and second "L"-shaped bottom bars (1325, 1326) are respectively and removably received in the first and second coupling grooves (1261, 1262) to secure the target assembly (130) to the base (120).

The base (120) further includes a ball guide channel (128) at least partially formed along the first and second "L"-shaped bottom bars (1325, 1326) of the frame (132). The target assembly (130) further includes first and second ball guiding members (134, 135); these first and second ball guiding members (134, 135) may be constructed from any of the following materials: natural or synthetic fabric materials, elastic materials, fiberglass, and the like. The first ball guiding member (134) is attached to the netting (131) diagonally between the first side bar (1321) and the first "L"-shaped bottom bar (1325). The second ball guiding member (135) is attached to the netting (131) diagonally between the second side bar (1322) and the second "L"-shaped bottom bar (1326).

The materials used for the netting (131) and the frame (132) of the target assembly (130) are similar to those described in the first and second embodiments. The netting (131) may be made any of the following materials: natural or synthetic fabric materials, elastic materials, fiberglass, and the like. The materials used to construct the top bar (1323), the first and second "L"-shaped bottom bars (1325, 1326), the first side bar (1321), and the second side bar (1322) are made of plastic, polyvinyl chloride, steel or steel, titanium, fiber glass, carbon fiber, or other like materials.

Additionally, the frame (132) of the target assembly (130) may further include first, second, third, and fourth "L"-shaped connecting parts (1371, 1372, 1373, 1374). The first "L"-shaped connecting part (1371) connects the top bar (1323) to the first side bar (1321). The second "L"-shaped connecting part (1372) connects the top bar (1323) to the second side bar (1322). The third "L"-shaped connecting part (1373) connects the first side bar (1321) to the first "L"-shaped bottom bar (1325). The fourth "L"-shaped connecting part (1374) connects the second side bar (1322) to the second "L"-shaped bottom bar (1326). Preferably, the "L"-shaped connecting part is a two-way elbow fitting connecter as shown. The first, second, third, and fourth "L"-shaped connecting parts (1371, 1372, 1373, 1374) have substantially same structure and sizes. The respective "L"-shaped connecting parts may receive ends of the respective bars in a snug fit via openings on either ends of the "L"-shaped connecting part. Furthermore, the "L"-shaped connecting parts may include a screw- or a screw-nut-tightening system as shown to further secure the ends of the respective bars in the "L"-shaped connecting parts. Once the end of the respective bar is fitted into the opening of one end of the "L"-shaped connecting part, the screw- or the screw-nut tightening system may be adjusted by an appropriate screwdriver, hextool, or the like that pushes a screw inwards towards to the end of the bar received therein the "L"-shaped connecting part.

For easy and convenient assembly of the target assembly (130) of the golf apparatus, the top bar (1323), the first side bar (1321), and the second side bar (1322) have substantially the same structure and sizes. The top bar (1323), the first and second "L"-shaped bottom bars (1325, 1326), the first side bar (1321), and the second side bar (1322) being made of plastic, polyvinyl chloride, steel or steel, titanium, fiber glass, carbon fiber, or other like materials that can be used to construct the bars of the target assembly (130) that are substantially uniform in structure and size. The target assembly (130), when assembled, may be a wide shape or a tall shape.

The base (120) may further include a ball guide channel (128) at least partially formed along the first and second "L"-shaped bottom bars (1325, 1326) of the frame (132). The ball guide channel (128) is constructed to return the ball to the user. The target assembly (130) may further include first and second ball guiding members (134, 135). The first ball guiding member (134) is attached to the netting (131) diagonally between the first side bar (1321) and the first "L"-shaped bottom bar (1325), and the second ball guiding member (135) is attached to the netting (131) diagonally between the second side bar (1322) and the second "L"-shaped bottom bar (1326). Once the golf ball is struck by the user and lands on the netting (131), the ball rolls down the net and encounters either the first and second ball guiding members (134, 135) that are constructed to direct the falling ball to the ball guide channel (128), which then returns the ball to the user for a subsequent practice shot. The netting (131) of the golf practice apparatus (100) may include a top sleeve (1313), a first side sleeve (1311), and a second side sleeve (1312). As shown, the netting (131) is associated with the frame (132) of the target assembly (130) with a top bar (1323) of the frame (132) received in the top sleeve (1313), a first side bar (1321) of the frame (132) received in the first side sleeve (1311), and a second side bar (1322) of the frame (132) is received in the second side sleeve (1312).

The top, first side, and second side sleeves (1313, 1311, 1312) each have an internal cavity and two ends, the two ends are preferably constructed to be open. The top, first side, and second side sleeves (1313, 1311, 1312) may be constructed to open lengthwise to permit the top, first side, and second side bars (1323, 1321, 1322) to be placed in the top, first side, and second side sleeves (1313, 1311, 1312) respectively. Included on the lengthwise portions of the sleeves are complimentary fasteners, examples of fasteners that may be found on the sleeves include, but are not limited to, hook and loop fasteners, button fasteners, a zipper system, snap fasteners, grommet fasteners, magnet fasteners, and the like. Alternatively, the sleeves may be closed lengthwise where the top, first side, and second side bars (1323, 1321, 1322) slide into the internal cavity of the top, first side, and second side sleeves (1313, 1311, 1312) respectively using the open ends of the sleeves. As for materials used in their construction, the top, first side, and second side sleeves (1313, 1311, 1312) made from natural or synthetic fabric materials or materials such as leather for added strength and longevity to support the target assembly (130) across numerous sessions with the golf practice apparatus (100).

The netting (131) may be stitched onto the top, first side, and second side sleeves (1313, 1311, 1312) as shown. If the netting (131) is stitched onto the top, first side, and second side sleeves (1313, 1311, 1312), then the sleeves are constructed to open lengthwise and include fasteners, preferably fasteners like the snap fasteners, grommet fasteners, button fasteners, magnet fasteners, hoop and loop fasteners, and the like such that the sleeves may receive the top, first side, and second side bars (1323, 1321, 1322) having the netting (131) stitched thereon and close the sleeves using the fasteners joining together through openings of the netting (131).

The netting (131) further includes a flap (1318) that is downwardly extended over the first and second "L"-shaped bottom bars (1325, 1326) of the frame (132) to guide a falling ball to the ball guide channel (128). A diagonal attachment between the first ball guiding member (134) and the netting (131) extends from the first side bar (1321) to the first "L"-shaped bottom bar (1325) on or about the flap (1318) or within the flap (1318) such that the first ball guiding member (134) is substantially contiguous with the flap (1318). This construction permits the ball to roll down the first ball guiding member (134) to the flap (1318), then to the ball guide channel (128) of the base (120), and then to the user. Similarly, a diagonal attachment between the second ball guiding member (135) and the netting (131) extends from the second side bar (1322) to the second "L"-shaped bottom bar (1326) on or about the flap (1318) or within the flap (1318) such that the second ball guiding member (135) is substantially contiguous with the flap (1318). This construction similarly permits the ball to roll down the second ball guiding member (135) to the flap (1318), then to the ball guide channel (128) of the base (120), and then to the user. As shown, the diagonal attachments may be achieved via stitching the netting (131) to the first and second ball guiding members (134, 135), which prevents the ball from going to some location other than towards the ball guide channel (128) of the base (120). A portion of the flap (1318) may include a hook and loop fastener to removably attach the portion of the flap (1318) with the base (120).

The netting (131) may further include a pouch (1319) that may be directly or indirectly connected to the ball guide channel (128). As shown in FIG. 10, the pouch (1319) is made from a similar material as the netting (131). Furthermore, the pouch (1319) is preferably constructed to connect to the ball guide channel (128) of the base (120) directly. When the user strikes a ball and the ball lands in the pouch (1319), the ball rolls down therein the pouch (1319) as shown. The pouch (1319) guides the ball to a rear opening in the base (120) that empties the ball into the ball channel guide (128) and then back to the user. The pouch (1319) of the netting (131) may be a plurality of pouches each emptying into the ball guide channel (128) of the base (120) directly.

The target assembly (130) may include a targeting sheet that overlays a portion of the netting (131). The targeting sheet includes at least one pouch (1319). The targeting sheet may be constructed to hold multiple pouches that are arrayed to form a set of targets for the golf ball. The targeting sheet may further include graphics, logos, text, or the combination of any two or three of them. These graphics, logos, and/or text may include visually stimulating graphics, instructions to hit the golf ball, or even rules for a putting game to be played by the user or a group of users.

The green portion (122) includes a top and a bottom with the top include synthetic lawn made from materials like polyethylene or monofilament polyethylene blend fibers to mimic grassy greens typically found in golf courses. The bottom of the green portion (122) is made from synthetic material as well, preferably synthetic rubber and the like for its pliability and grip on many surfaces, other pliant synthetic materials may be used. When the user is finished with their putting practice or putting game for the day, the user can easily dissemble the target assembly (130) and the mat (110) from the base (120) and roll up the mat (110) to be stored.

Figure 11A:
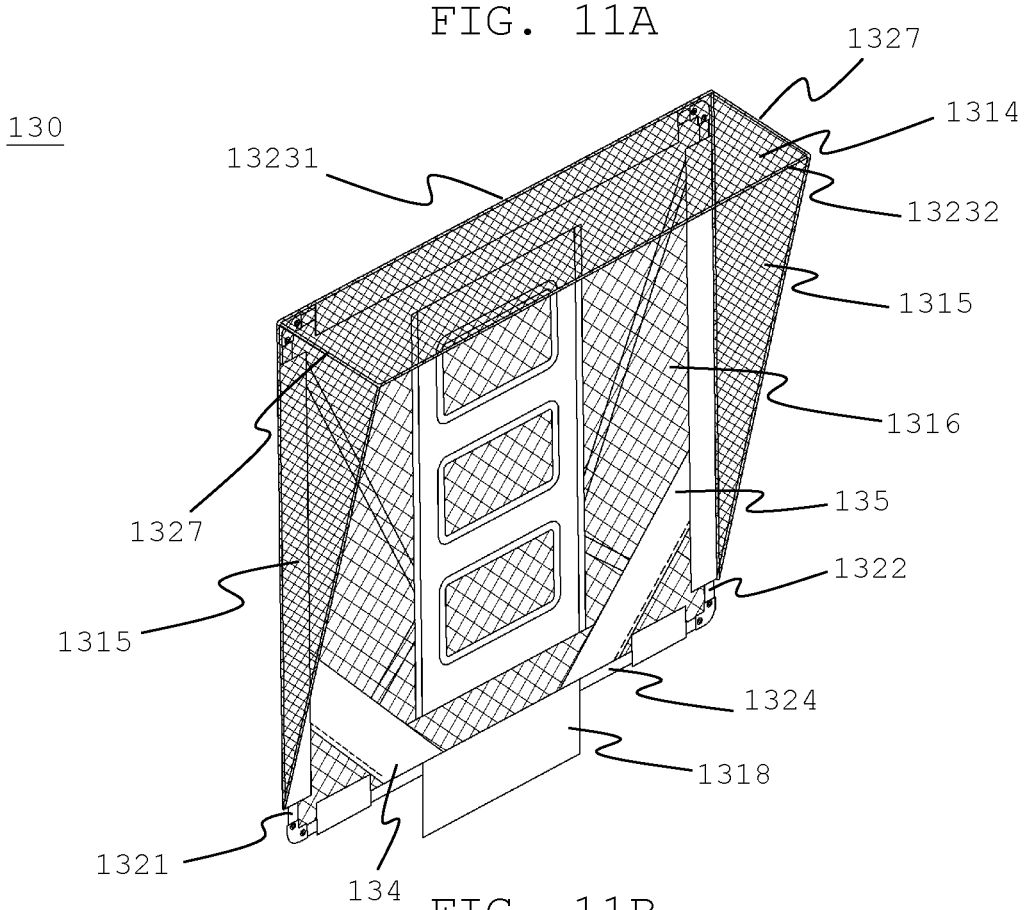
FIGS. 11A-B show perspective and side views of a netting thereof according to embodiments of the present invention.
Figure 11B:
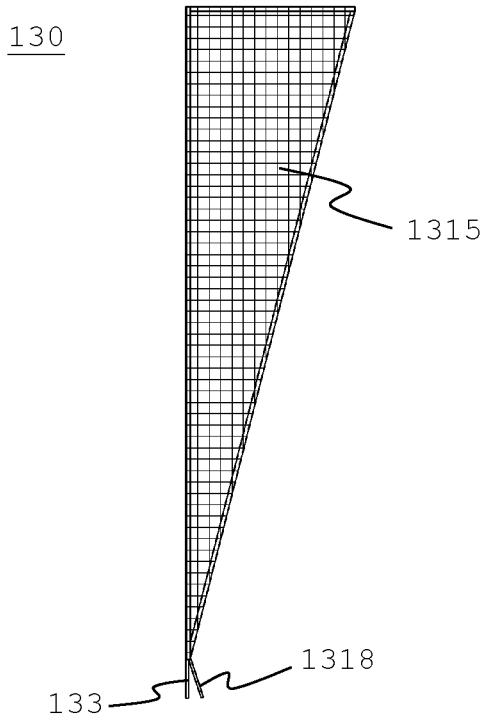

For all of the embodiments described above and below, an alternative netting (131) of a target assembly (130) is shown in FIGS. 11A-B. As shown in FIG. 11A, the frame (132) may further include top-side bars (1327). The top bar (1323) may include first and second top bars (13231, 13232). The netting (131) may include a back net (1316) that is supported by the first and second side bars (1321, 1322), the bottom bar (1324), and the first top bar (13231); a top net (1314) that is supported by the top-side bars (1327) and the first and second top bars (13231, 13232), the top net (1314) connected to a top side of the back net (1316); and two side nets (1315) to at least partially cover each of the open lateral sides formed by the back net (1316) and the top net (1314). Each of side nets (1315) is supported by one of the first and second side bars (1321, 1322) and one of the top-side bars (1327). For example, one of the side nets (1315) (e.g. first side net) is supported by the first side bar (1321) and one of the top-side bars (1327), and another side net (1315) (e.g. second side net) is supported by the second side bar (1322) and one of the top-side bars (1327) that is not supporting the first side net. Alternatively, the first side net is supported by the second side bar (1322) while the second side net is supported by the first side bar (1321). The back net (1316) and the top net (1314) form open lateral sides that are at least partially covered by the side nets (1315) as shown in FIGS. 11A-B, e.g. one open lateral side is at least partially covered by a least one of the side nets (1315). The netting (131) here may be made any of the following materials: natural or synthetic fabric materials; elastic materials; fiberglass; thin or thick plastic material such as those found in tents; and the like.

As shown in FIG. 11B, the netting (131) can be detachably coupled to the base (120) by the connecting member (133) of the target assembly (130). As in the embodiments described above, the connecting member (133) is removably received in the coupling groove (126) to secure the target assembly (130) to the base (120). The netting (131) may further include first and second ball guiding members (134, 135) as shown. The side nets (1315) aids in ball recovery by directing golf balls towards the back net (1316) then down to the flap (1318) that is downwardly extended over a bottom bar (1324) of the frame (132) to guide a falling ball to the ball guide channel (128) similarly as described above. As shown, the first and second ball guiding members (134, 135) may serve as further aids to direct the golf ball to the flap (1318), which then guides the falling ball to the ball guide channel (128).

Figure 12A:
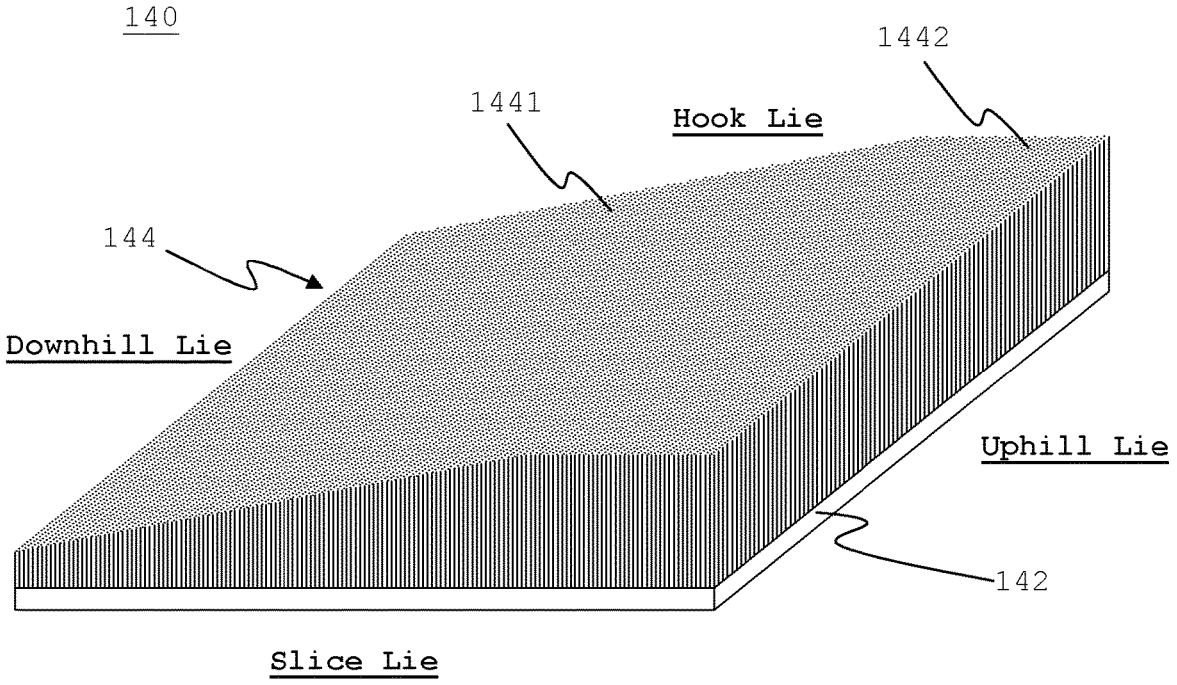
FIGS. 12A-B show perspective views of chipping mats according to embodiments of the present invention.
Figure 12B:
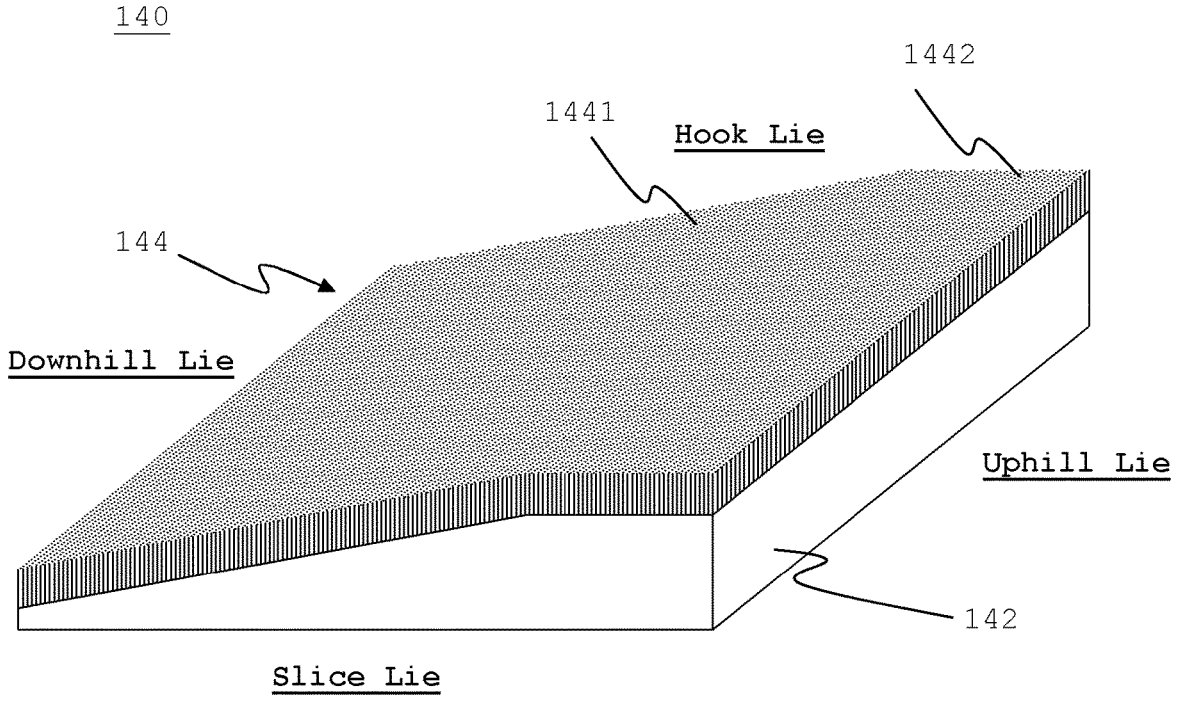

In all of the embodiments of the golf practice apparatus (100) for putting and short-game practice described above, the golf practice apparatus (100) may further include at least one chipping mat (140) as shown in FIGS. 12A-B. A golfer may face various lies on the grounds of a fairway such as a flat lie or sloping lies such as a downhill lie, an uphill lie, a hook lie, and a slice lie. Different strategies are employed when facing these different lies (e.g. shifting distribution of weight on one leg, knee position, alignment of the shoulders to the angle of the ground, etc.) For the sloping lies, the downhill lie is where the golf ball is positioned on a downhill slope, the uphill lie is where the golf ball is placed on an uphill slope, the hook lie is where the golf ball is below the feet, and the slice lie is where the golf ball is above the feet.

A chipping mat (140) may be used to simulate these lies to allow users of the golf practice apparatus (100) to practice different techniques when facing such features on a golf course. The chipping mat (140) may simulate the flat lie, or any of the sloping lies such as the downhill lie, the uphill lie, the hook lie, and the slice lie. The chipping mat (140) includes a base (142) and a green (144) on top of the base. The green includes first (1441) and second portions (1442), wherein the first portion (1441) of the green (144) is angled with respect to a ground and the second portion (1442) of the green (144) is substantially parallel to the ground. The green (144) is made of artificial turf or artificial grass. Accordingly, the green (144) may be made from nylon, polypropylene, or polyethylene fibers. Depending on the user's practice preferences, the chipping mat (140) may be placed near or approximate to the mat; further away from the mat; or near or approximate to another chipping mat (140) where this other chipping mat (140) is near or approximate to the mat (110). Further shown in FIGS. 12A-B, the chipping mat (140) can simulate the different lies listed above. A user may rotate the chipping mat (140) (90° clockwise or counterclockwise) to choose which lie to practice chipping on with the mat (110). For example, a user having right-handed shot that desires to practice chipping on a downhill lie with the golf practice apparatus (100), the user will position the downhill lie edge of the chipping mat (140) as shown in FIGS. 12A-B to an edge of the mat (110). If the same user having the right-handed shot desires to switch to practice chipping on a slice lie, the user will rotate the chipping mat (140) so that the slice lie edge of the chipping mat (140) will be positioned about the edge of mat (110). Likewise, the user having the right-handed shot will rotate the chipping mat (140) to the uphill lie edge or the hook lie edge of the chipping mat (140) to the edge of the mat (110) to practice chipping on those lies. For a left-handed shot, the indicated downhill lie shown in FIGS. 12A-B will be the uphill lie, the indicated uphill lie will be the downhill lie, the indicated slice lie will be the hook lie, and the indicated hook lie will be the slice lie.

The chipping mat (140) as shown FIG. 12A has a thinner base (142) than the chipping mat (140) shown in FIG. 12B. The user may prefer the stability provided by the thicker base shown in FIG. 12B. However, the thickness of the base (142), as well as the height of the green (144), as shown in FIGS. 12A-B are for illustrative purposes only, as the height of the green (144) and the thickness of the base may adopt a wide variety of values without departing from the scope and spirit of the present invention—likewise for the shape of the chipping mat (140), which is shown in FIGS. 12A-B as having a base (142) wherein a bottom of the base (142) that faces the ground is substantially square. The bottom of the base (142) may adopt other shapes. Additionally, the angle of the first portion (1441) of the green (144) is also for illustrative purposes only, as the first portion (1441) of the green (144) may adopt a wide variety of angles without departing from the scope and spirit of the present invention.

While the invention has been shown and described with reference to different embodiments thereof, it will be appreciated by those skilled in the art that variations in form, detail, compositions and operation may be made without departing from the spirit and scope of the invention as defined by accompanying claims.

What is claimed is:

1. A golf practice apparatus for putting and short game practices, comprising:

a base which includes a green portion, a hole, and a coupling groove;

a mat which includes a first end portion and a second end portion, wherein the second end portion is attached to the base; and a target assembly that includes a netting, a frame, and a connecting member, wherein the coupling groove of the base and the connecting member of the target assembly are constructed such that the connecting member is removably received in the coupling groove to secure the target assembly to the base, wherein the frame of the target assembly comprises a top bar, a bottom bar, a first side bar, and a second side bar, wherein the base further includes a ball guide channel at least partially formed along the bottom bar of the frame, and wherein the target assembly further includes a first ball guiding member which is attached to the netting diagonally between the first side bar and the bottom bar, wherein the target assembly further includes a second ball guiding member which is attached to the netting diagonally between the second side bar and the bottom bar, wherein a lower side of the first ball guiding member is attached to the netting diagonally via stitching, and wherein a lower side of the second ball guiding member is attached to the netting diagonally via stitching.

2. The golf practice apparatus of claim 1, wherein the connecting member of the target assembly comprises a flat plate fixedly attached to the frame, and wherein the coupling groove of the base comprises a slot to receive the flat plate therein.

3. The golf practice apparatus of claim 2, wherein the connecting member of the target assembly further comprises a groove and a slanted part, and wherein the coupling groove of the base further comprises a protrusion so that the protrusion is removably received in the groove.

4. The golf practice apparatus of claim 2, wherein the connecting member is fixedly attached to or is extended from the bottom bar.

5. The golf practice apparatus of claim 4, wherein the flat plate is made of plastic, polyvinyl chloride, steel or steel, titanium, fiber glass, or carbon fiber, and wherein the top bar, the bottom bar, the first side bar, and the second side bar are made of plastic, polyvinyl chloride, steel or steel, titanium, fiber glass, or carbon fiber.

6. The golf practice apparatus of claim 4, wherein the frame of the target assembly further comprises first, second, third, and fourth "L"-shaped connecting parts, wherein the first "L"-shaped connecting part connects the top bar to the first side bar, wherein the second "L"-shaped connecting part connects the top bar to the second side bar, wherein the third "L"-shaped connecting part connects the first side bar to the bottom bar, and wherein the fourth "L"-shaped connecting part connects the second side bar to the bottom bar.

7. The golf practice apparatus of claim 6, wherein the first, second, third, and fourth "L"-shaped connecting parts have substantially same structure and size.

8. The golf practice apparatus of claim 4, wherein the top bar, the first side bar, and the second side bar have substantially same structure and size.

9. The golf practice apparatus of claim 4, wherein the frame further includes top-side bars, wherein the top bar includes first and second top bars, and wherein the netting comprises:

a back net that is supported by the first and second side bars, the bottom bar, and the first top bar;

a top net that is supported by the top-side bars and the first and second top bars, the top net is connected to a top side of the back net; and side nets, wherein each of the side nets is supported by either of the first and second side bars and at least one of the top-side bars, wherein the back net and the top net form open lateral sides, and wherein the open lateral sides are at least partially covered by the side nets.

10. The golf practice apparatus of claim 1, wherein the netting comprises a top sleeve, a first side sleeve, a second side sleeve, and a flap which is downwardly extended over a bottom bar of the frame to guide a falling ball to the ball guide channel, wherein a top bar of the frame is received in the top sleeve, wherein a first side bar of the frame is received in the first side sleeve, wherein a second side bar of the frame is received in the second side sleeve, and wherein the diagonal attachment between the first ball guiding member and the netting extends to the bottom bar on or about the flap or within the flap.

11. The golf practice apparatus of claim 1, wherein the netting comprises a pouch which is connected to the ball guide channel.

12. The golf practice of claim 1, further comprising a chipping mat that is constructed for chipping a golf ball using a golf club, wherein the chipping mat includes a base and a green on top of the base, wherein the green includes first and second portions, wherein the first portion of the green is angled with respect to a ground and the second portion of the green is substantially parallel to the ground, and wherein the green is made of artificial turf or artificial grass.

13. A golf practice apparatus for putting and short game practices, comprising:

a base which includes a green portion, a hole, and first and second coupling groove;

a mat which includes a first end portion and a second end portion, wherein the second end portion is attached to the base; and a target assembly that includes a netting, a frame, and first and second connecting members, wherein the first and second coupling grooves of the base and the connecting members of the target assembly are constructed such that the first and second connecting members are respectively and removably received in the first and second coupling grooves to secure the target assembly to the base, wherein the frame of the target assembly comprises a top bar, a bottom bar, a first side bar, and a second side bar, wherein the base further includes a ball guide channel at least partially formed along the bottom bar of the frame, wherein the target assembly further includes first and second ball guiding members, wherein the first ball guiding member is attached to the netting diagonally between the first side bar and the bottom bar, wherein the second ball guiding member is attached to the netting diagonally between the second side bar and the bottom bar, wherein a lower side of the first ball guiding member is attached to the netting diagonally via stitching, and wherein a lower side of the second ball guiding member is attached to the netting diagonally via stitching.

14. The golf practice apparatus of claim 13, wherein the first and second connecting members are fixedly attached to, or extended from, the bottom bar.

15. A golf practice apparatus for putting and short game practices, comprising:

a base which includes a green portion, a hole, and first and second coupling groove;

a mat which includes a first end portion and a second end portion, wherein the second end portion is attached to the base; and a target assembly that includes a netting, and a frame, wherein the frame comprises a top bar, a first side bar, a second side bar, and first and second "L"-shaped bottom bars, wherein the first and second coupling groove of the base and the first and second "L"-shaped bottom bars are constructed such that the first and second "L"-shaped bottom bars are respectively and removably received in the first and second coupling grooves to secure the target assembly to the base, wherein the base further includes a ball guide channel at least partially formed along the first and second "L"-shaped bottom bars of the frame, and wherein the target assembly further includes first and second ball guiding members, wherein the first ball guiding member is attached to the netting diagonally between the first side bar and the first "L"-shaped bottom bar, wherein the second ball guiding member is attached to the netting diagonally between the second side bar and the second "L"-shaped bottom bar, and wherein one side of the first and second ball guiding members is attached to the netting diagonally via stitching.

16. The golf practice apparatus of claim 15, wherein the netting comprises a flap which is downwardly extended toward the base to guide a falling ball to the ball guide channel.

* * * * *